US012553256B2

(12) United States Patent
Wang

(10) Patent No.: US 12,553,256 B2
(45) Date of Patent: Feb. 17, 2026

(54) FOLDABLE TENT WITH EAVES

(71) Applicant: XIAMEN MOQI INDUSTRY AND TRADE CO., LTD., Xiamen (CN)

(72) Inventor: Xingling Wang, Xiamen (CN)

(73) Assignee: XIAMEN MOQI INDUSTRY AND TRADE CO., LTD., Xiamen (CN)

( * ) Notice: Subject to any disclaimer, the term of this patent is extended or adjusted under 35 U.S.C. 154(b) by 230 days.

(21) Appl. No.: 18/612,679

(22) Filed: Mar. 21, 2024

(65) Prior Publication Data

US 2024/0318457 A1 Sep. 26, 2024

(30) Foreign Application Priority Data

Mar. 25, 2023 (CN) ..... 202320609733.X

(51) Int. Cl.

| | |
|---|---|
| ***E04H 15/58*** | (2006.01) |
| ***E04H 15/46*** | (2006.01) |
| ***E04H 15/50*** | (2006.01) |
| ***E04H 15/60*** | (2006.01) |

(52) U.S. Cl.

CPC ..... *E04H 15/50* (2013.01); *E04H 15/46* (2013.01); *E04H 15/58* (2013.01); *E04H 15/60* (2013.01)

(58) Field of Classification Search

CPC ..... E04H 15/50; E04H 15/58

See application file for complete search history.

(56) References Cited

U.S. PATENT DOCUMENTS

| | | | | |
|---|---|---|---|---|
| 9,926,720 | B2 * | 3/2018 | Huang | E04H 15/54 |
| 10,309,121 | B2 * | 6/2019 | Choi | E04H 15/50 |
| 12,037,808 | B2 * | 7/2024 | Sun | E04H 15/50 |
| 12,139,926 | B2 * | 11/2024 | Lu | E04H 15/48 |
| 2011/0073148 | A1 * | 3/2011 | Choi | E04H 15/50 135/144 |
| 2023/0295931 | A1 * | 9/2023 | Xu | E04H 15/50 135/20.1 |
| 2023/0399869 | A1 * | 12/2023 | Grace | E04H 15/50 |
| 2024/0026704 | A1 * | 1/2024 | Lu | E04H 15/48 |
| 2025/0347140 | A1 * | 11/2025 | Yuan | E04H 15/18 |

* cited by examiner

*Primary Examiner* — Robert Canfield

(57) ABSTRACT

Disclosed is a foldable tent with eaves. The foldable tent with eaves includes a tent roof connection block, where a plurality of eaves folding assemblies are connected to a bottom of the tent roof connection block, the eaves folding assemblies include tent roof supporting rods I, tops of the tent roof supporting rods I extend into the tent roof connection block, and the other ends of the tent roof supporting rods I are connected to connection blocks; and the connection blocks are internally connected to tent roof supporting rods II, and the other ends of the tent roof supporting rods II are connected to corner connection blocks. The foldable tent with eaves is stabler when being unfolded. The effect of sheltering from sun and preventing rain from intruding into the tent in rainy days is realized. The tent can be folded as whole, and is convenient to store.

10 Claims, 12 Drawing Sheets

FOLDABLE TENT WITH EAVES

CROSS REFERENCE TO RELATED APPLICATION

This application claims priority benefit of Chinese patent Application No. 202320609733. X, filed on Mar. 25, 2023, and the entire contents of which are incorporated herein by reference.

TECHNICAL FIELD

The disclosure relates to the technical field of tents, and in particular to a foldable tent with eaves.

BACKGROUND

Since an existing tent is equipped without extended eaves, when the tent is set up to a high position, a shadow area covered by the tent will be narrowed by oblique sunlight, and a sun sheltering effect of the tent will be affected by the sunlight entering the tent. Moreover, rainwater is likely to invade into the tent without the eaves in rainy days, and a rain sheltering effect of the tent is affected accordingly.

SUMMARY

In view of the above, the disclosure provides a foldable tent with eaves. Accordingly, the problem that a tent without extended eaves is insufficient to shelter from sun and rain is solved through eaves folding assemblies.

In order to realize the above objective, the disclosure provides the technical solution as follows: a foldable tent with eaves includes a tent roof connection block, where a plurality of eaves folding assemblies are connected to a bottom of the tent roof connection block, the eaves folding assemblies include tent roof supporting rods I, tops of the tent roof supporting rods I extend into the tent roof connection block, and the other ends of the tent roof supporting rods I are connected to connection blocks; the connection blocks are internally connected to tent roof supporting rods II, the other ends of the tent roof supporting rods II are connected to corner connection blocks, and the tent roof supporting rods II are snapped into plastic sliding members; eaves rods are inserted into the sliding plastic members, one ends of the eaves rods are connected to plastic connectors, one sides of the plastic connectors are connected to linkage rods, and short rods are inserted into the plastic connectors; one ends of the short rods are connected to fastener blocks, foldable supporting rods are connected between every two adjacent corner connection blocks and between every two adjacent fastener blocks, fastener buttons are arranged inside the fastener blocks, and supporting rod stretching and retracting units are inserted inside the fastener blocks; and the supporting rod stretching and retracting units include movable supporting rods, rod sleeves are fixedly embedded in bottoms of the movable supporting rods, fixed supporting rods are inserted into the rod sleeves, leaf springs I are fixedly arranged inside the movable supporting rods, and leaf springs II are fixedly arranged inside the rod sleeves.

Preferably, one ends of the tent roof supporting rods I are movably connected to the tent roof connection block through rotary shafts, and the other ends of the tent roof supporting rods I are movably connected to the connection blocks through rotary shafts.

Preferably, one ends of the tent roof supporting rods II are movably connected to the connection blocks through rotary shafts, the other ends of the tent roof supporting rods II are movably connected to the corner connection blocks through rotary shafts, and the plastic sliding members are hinged to the tent roof supporting rods II.

Preferably, the eaves rods penetrate the plastic sliding members and are slidably connected to the plastic sliding members, and the one ends of the eaves rods are movably connected to the plastic connectors through rotary shafts.

Preferably, one ends of the linkage rods are movably connected to the plastic connectors through rotary shafts, and the other ends of the linkage rods are movably connected to the tent roof supporting rods II through rotary shafts.

Preferably, one ends of the short rods are movably connected to the tent roof supporting rods II through rotary shafts, the other ends of the short rods are movably connected to one ends of the fastener blocks through rotary shafts, and the short rods penetrate the plastic connectors and are fixedly connected to the plastic connectors.

Preferably, four ends of the foldable supporting rods are movably connected to two corner connection blocks and two fastener blocks through rotary shafts respectively.

Preferably, tops of the movable supporting rods are fixedly connected to the corner connection blocks, the movable supporting rods penetrate the fastener blocks and are slidably connected to the fastener blocks, and the fixed supporting rods are snapped into the movable supporting rods.

Preferably, the leaf springs I are fixedly arranged inside the movable supporting rods, one sides of the leaf springs I are fixedly provided with bulges I, and the bulges I penetrate the movable supporting rods and extend into the fastener blocks.

Preferably, the leaf springs II are fixedly arranged inside the fixed supporting rods, one sides of the leaf springs II are fixedly provided with bulges II, and the bulges II penetrate one side walls of the movable supporting rods and one side walls of the fixed supporting rods and extend out of the movable supporting rods and the fixed supporting rods.

Embodiments of the disclosure have the advantages as follows:

1. The leaf springs I extend into the fastener blocks, so that the fastener blocks are fixed to exteriors the movable supporting rods. When the fastener blocks are fixed, the tent roof supporting rods II and the tent roof supporting rods I are straightened to be in a parallel state through the connection blocks. The short rods fix the eaves rods through the plastic connectors. The eaves rods are supported at two points through the plastic sliding members and the plastic connectors, so as to be stabler when being unfolded. The eaves rods extend out of a tent frame, so that tent cloth laid on an exterior of the tent extends out of the tent frame. Therefore, the effect of sheltering from sun and preventing rain from intruding into the tent in rainy days is realized.
2. Upon being ejected by the fastener buttons, the leaf springs I are retracted into the movable supporting rods, and the fastener blocks move along the movable supporting rods without limitation. When a plurality of fastener blocks move downwards, the tent roof supporting rods II and the tent roof supporting rods I are folded through the connection blocks upon the movement of the short rods. Moreover, the eaves rods are folded through the plastic connectors. In addition, when the fastener blocks move downwards, the plurality of fastener blocks drive the movable supporting rods to move close to one another upon folding the foldable supporting rods. When the leaf springs II are retracted into the fixed supporting rods, the limitation on the movable supporting rods along the fixed supporting rods is released, so that the fixed supporting rods and the rod sleeves are folded. Accordingly, the tent is folded as a whole, and is convenient to store.

3. A use area is expanded at the same position, and waterproof performance and wind resistance are improved.

BRIEF DESCRIPTION OF FIGURES

In order to describe the technical solutions in the implementation of the disclosure or the prior art more clearly, the accompanying drawings required for describing the implementation or the prior art will be briefly described below. Obviously, the accompanying drawings in the following description are merely illustrative. Those of ordinary skill in the art can also derive other implementation accompanying drawings from the accompanying drawings provided without creative efforts.

The structure, proportion, size, etc. shown in the description are merely used to jointly explain the contents disclosed in the description for understanding and reading by those skilled in the art, are not intended to limit the restrictive conditions implementable by the disclosure, and thus have no technical substantive meanings. Without affecting the effect and objectives realizable by the disclosure, any structural modification, proportion relation change, or size adjustment should still fall within the scope that the technical contents disclosed in the disclosure can cover.

Figure 1:
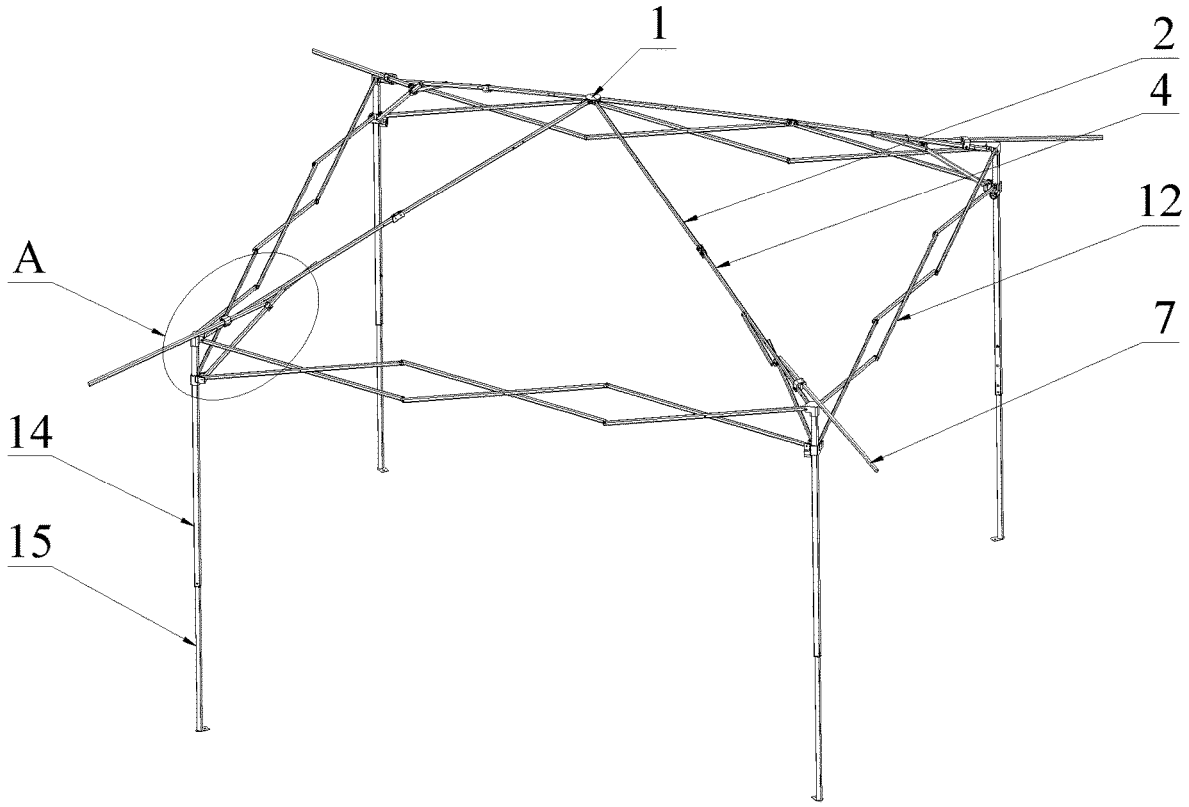
FIG. 1 is an overall schematic structural diagram according to the disclosure.
Figure 2:
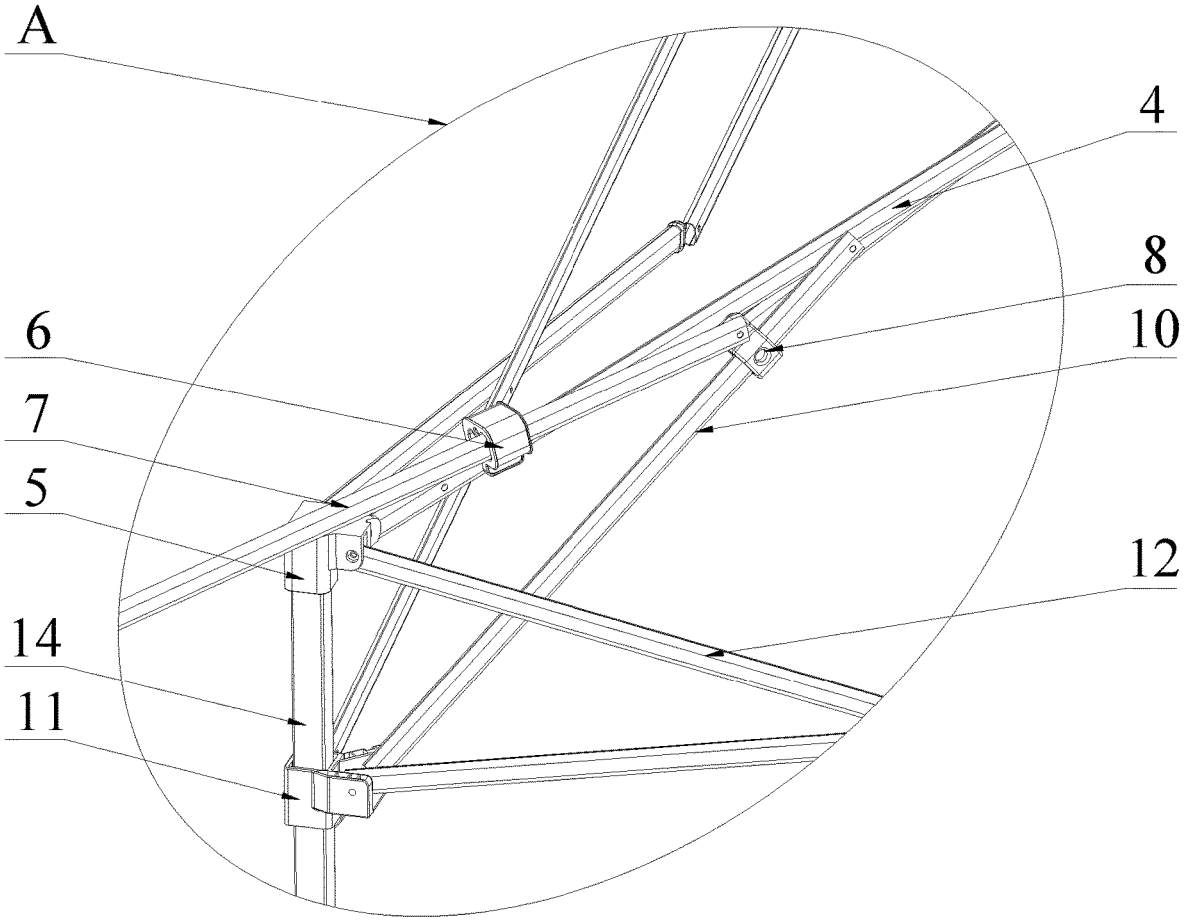
FIG. 2 is an enlarged structural diagram of portion A in FIG. 1 according to the disclosure.
Figure 3:
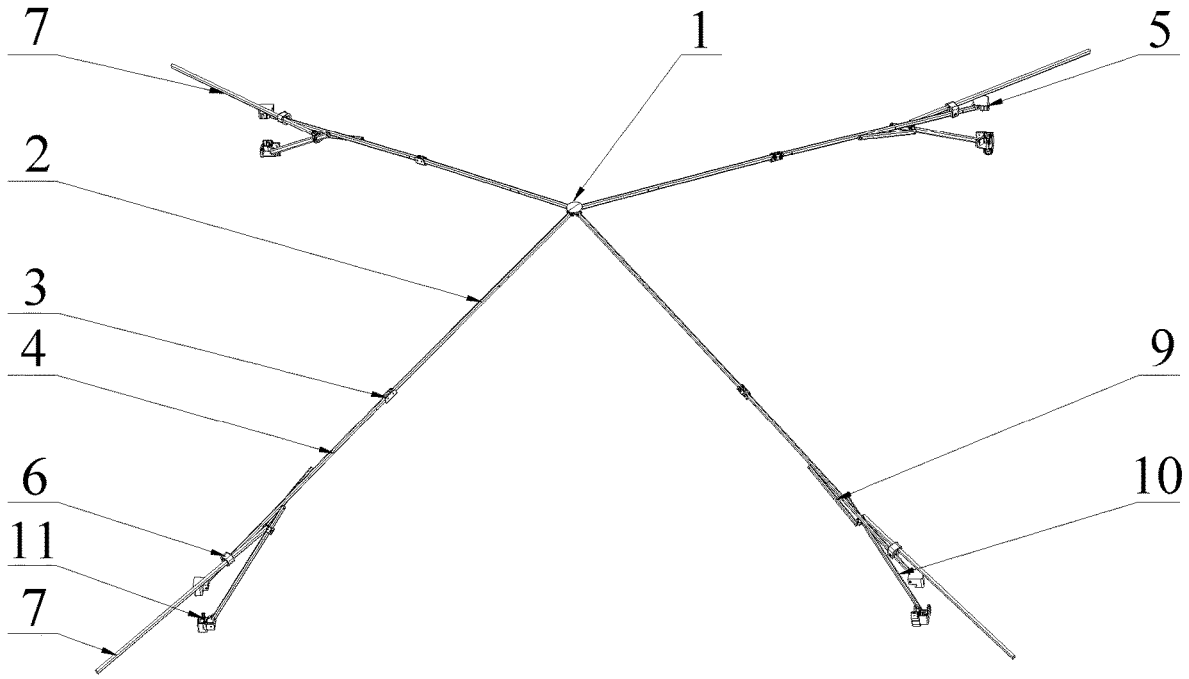
FIG. 3 is a solid diagram of a connection relation of an eaves folding assembly according to the disclosure.
Figure 4:
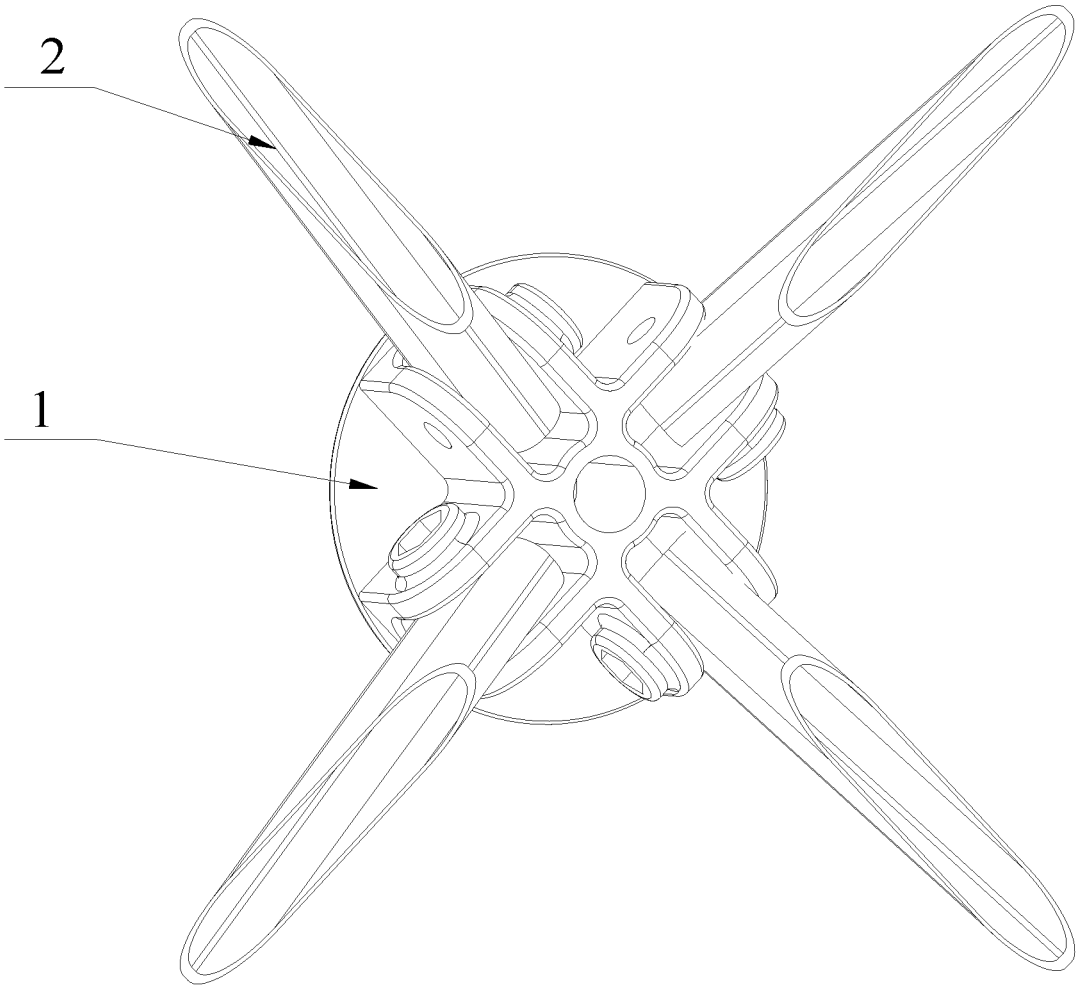
FIG. 4 is a solid sectional view of a bottom of a tent roof connection block according to the disclosure.
Figure 5:
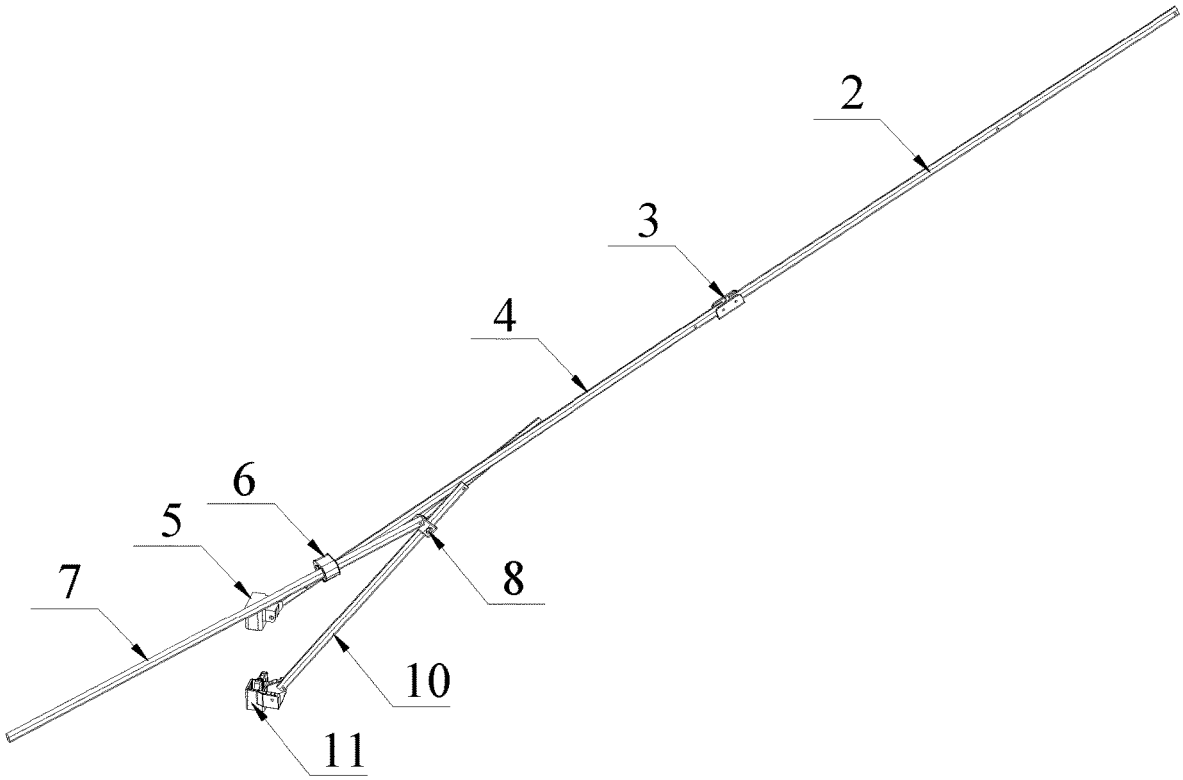
FIG. 5 is a solid diagram of an eaves folding assembly according to the disclosure.
Figure 6:
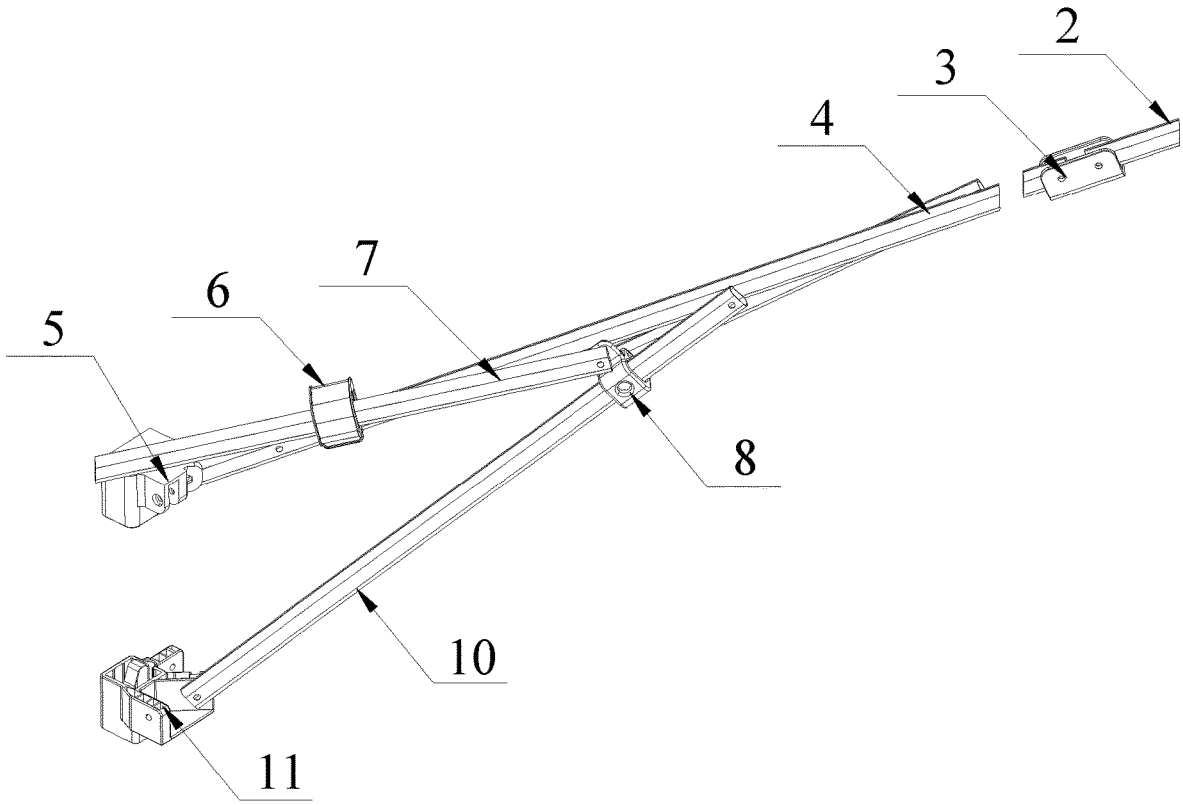
FIG. 6 is a solid diagram of a front view of a partial section of an eaves folding assembly according to the disclosure.
Figure 7:
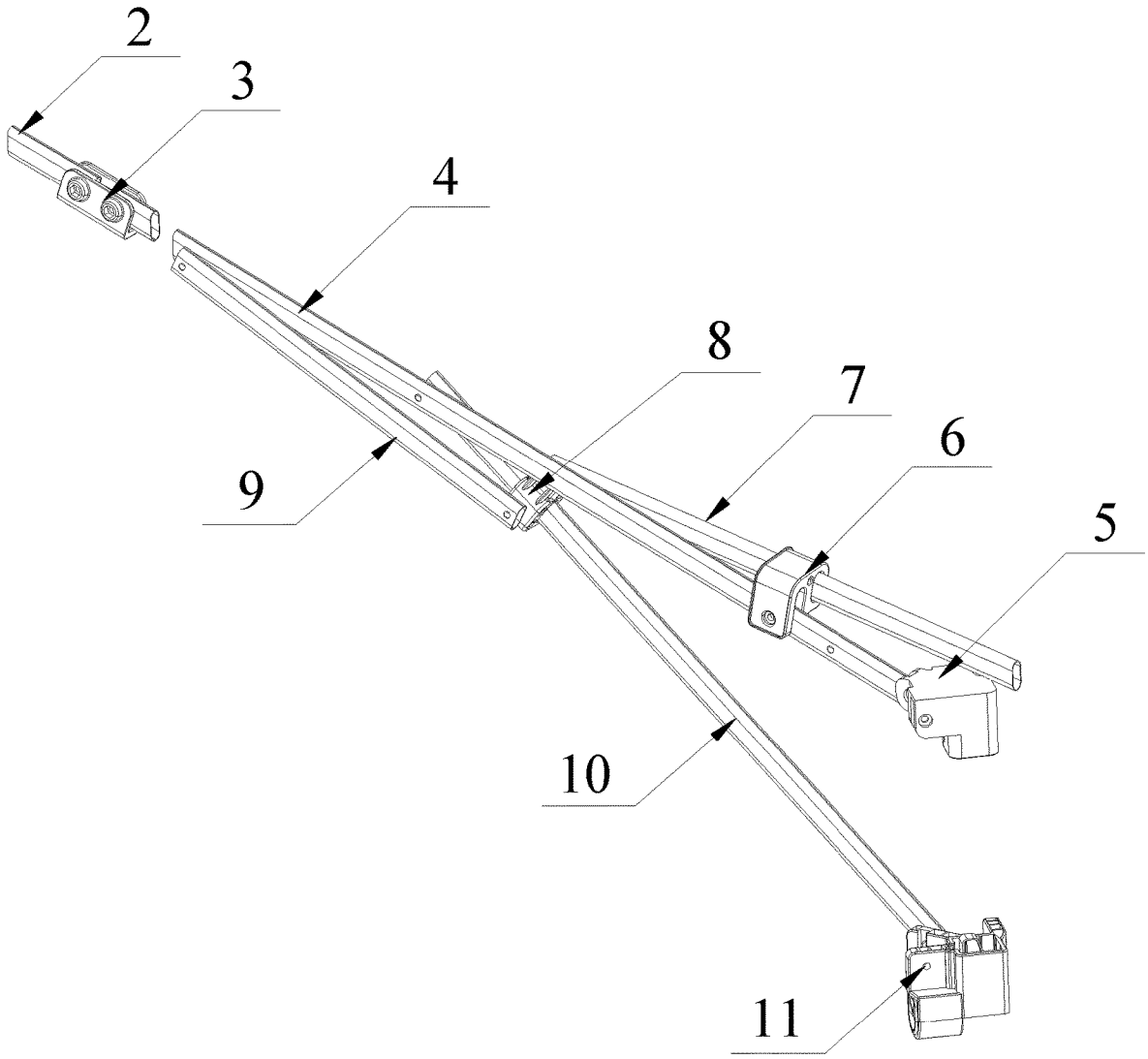
FIG. 7 is a solid diagram of a rear view of a partial section of an eaves folding assembly according to the disclosure.
Figure 8:
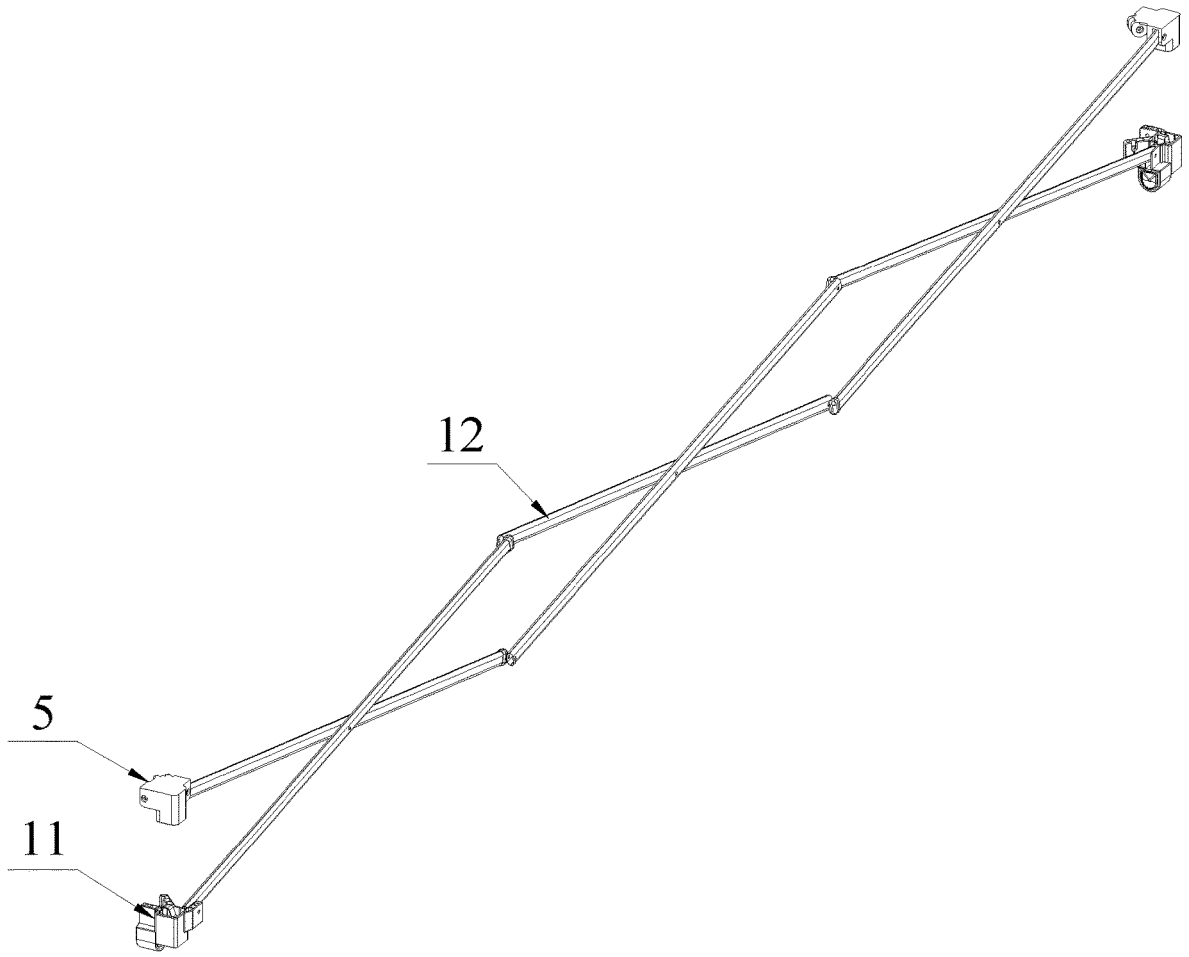
FIG. 8 is a solid diagram of a connection relation of two adjacent eaves folding assemblies according to the disclosure.
Figure 9:
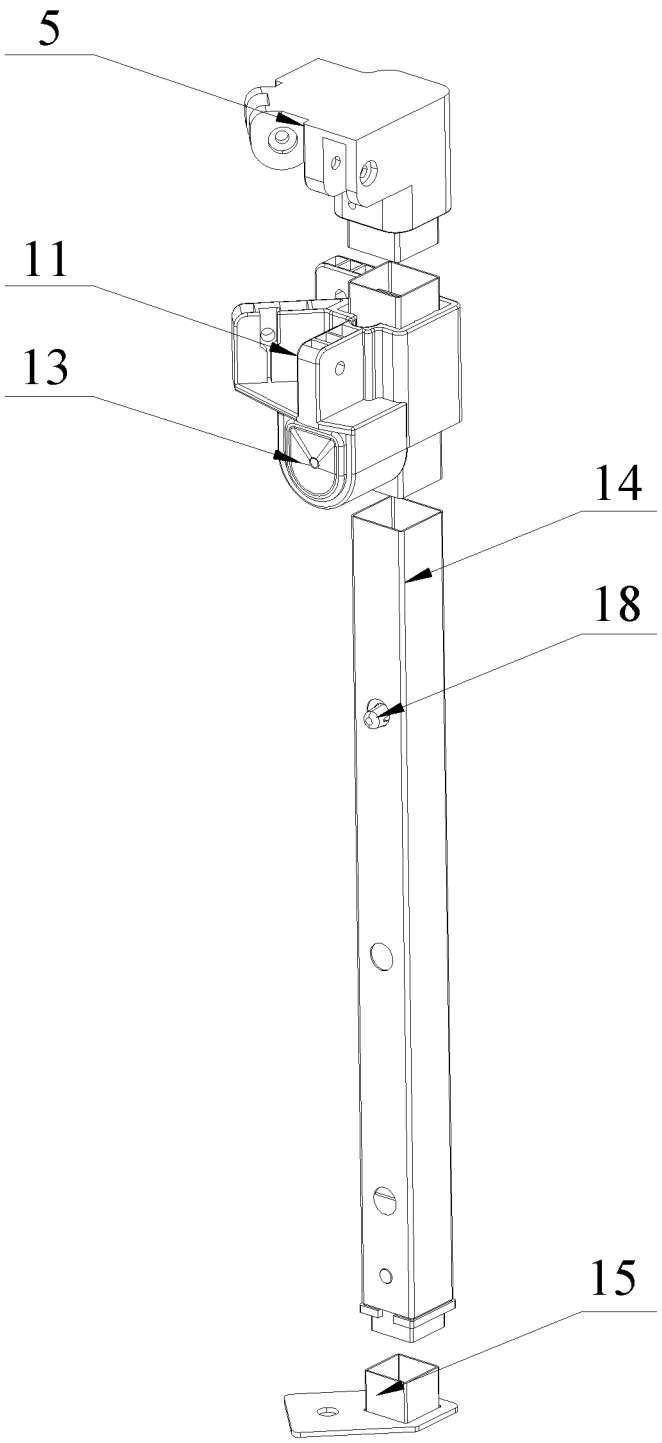
FIG. 9 is a solid diagram of a partial section of a supporting rod stretching and retracting unit according to the disclosure.
Figure 10:
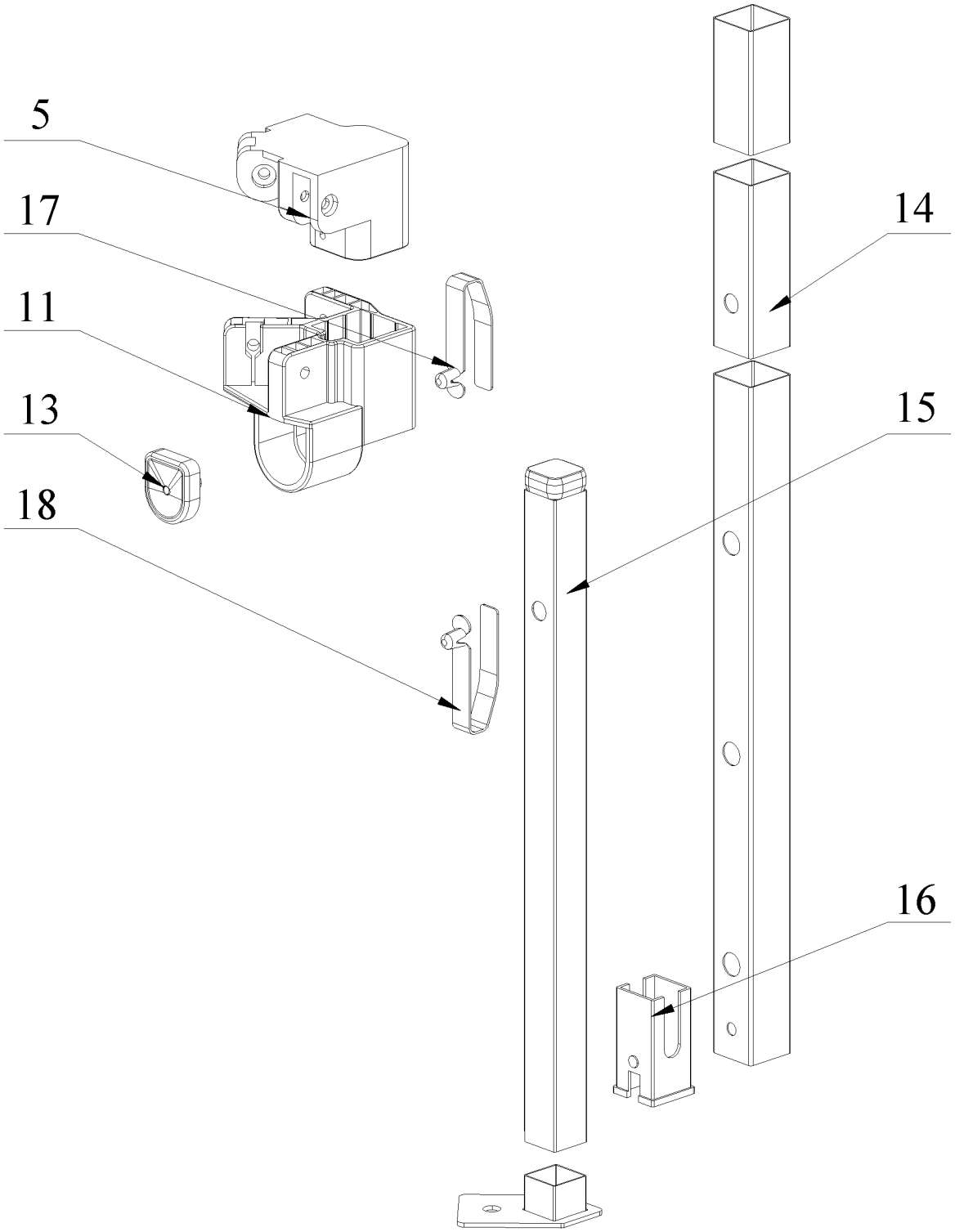
FIG. 10 is an exploded solid diagram of a partial section of a supporting rod stretching and retracting unit according to the disclosure.
Figure 11:
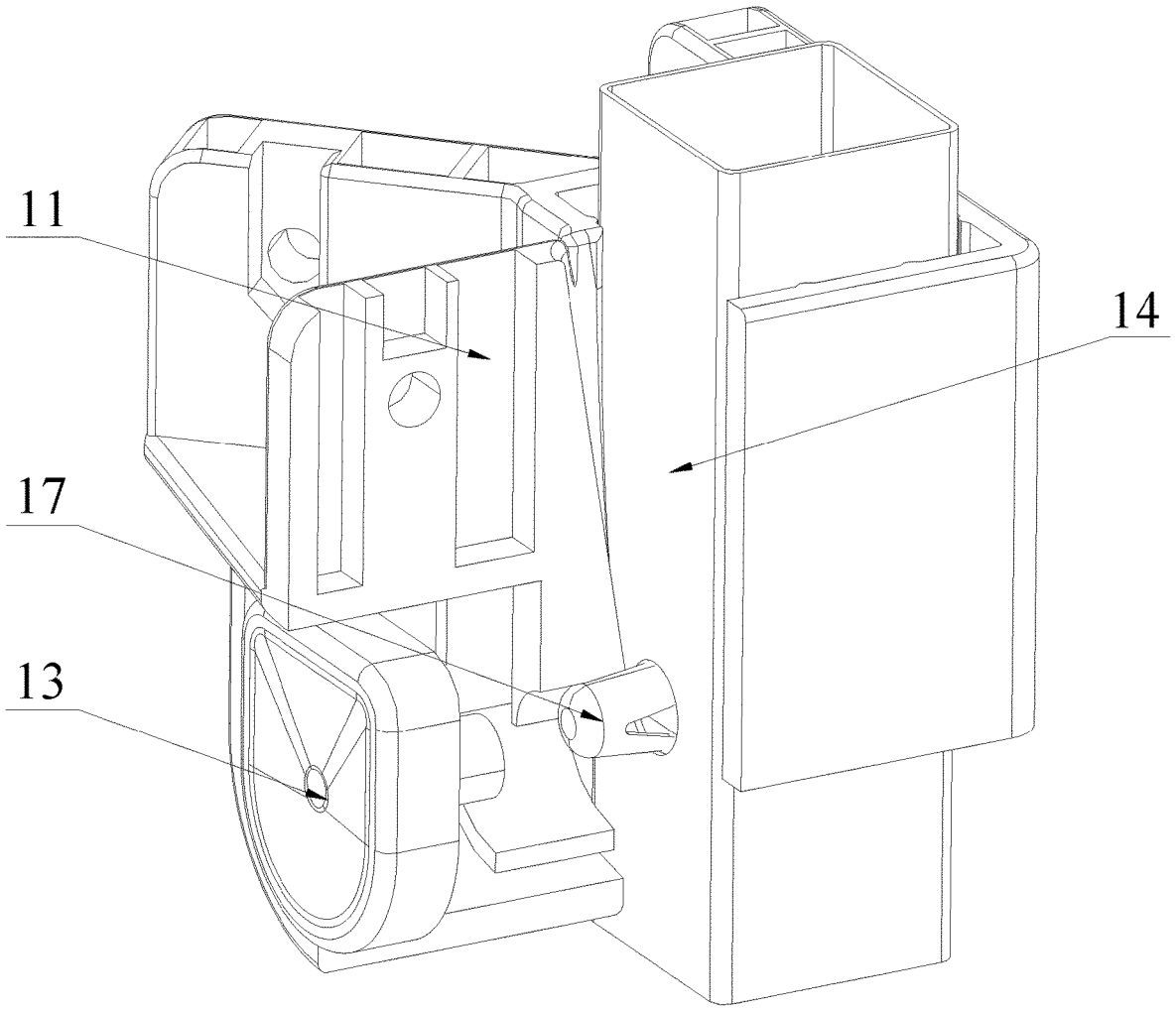
FIG. 11 is a solid diagram of a partial section of a fastener block according to the disclosure.

In the figures: 1 tent roof connection block, 2 tent roof supporting rod I, 3 connection block, 4 tent roof supporting rod II, 5 corner connection block, 6 plastic sliding member, 7 eaves rod, 8 plastic connector, 9 linkage rod, 10 short rod, 11 fastener block, 12 foldable supporting rod, 13 fastener button, 14 movable supporting rod, 15 fixed supporting rod, 16 rod sleeve, 17 leaf spring I, and 18 leaf spring II.

DETAILED DESCRIPTION

The implementation of the disclosure is described below with reference to particular specific embodiments. Other advantages and effects of the disclosure will be readily apparent to those skilled in the art from the contents disclosed in the description. Apparently, embodiments described herein are some embodiments rather than all embodiments of the disclosure. Based on the embodiments in the disclosure, all other embodiments derived by those of ordinary skill in the art without creative efforts fall within the scope of protection of the disclosure.

With reference to FIGS. 1-12, the disclosure provides a foldable tent with eaves. The foldable tent with eaves includes a tent roof connection block 1, where a plurality of eaves folding assemblies are connected to a bottom of the tent roof connection block 1, the eaves folding assemblies include tent roof supporting rods I 2, tops of the tent roof supporting rods I 2 extend into the tent roof connection block 1, and the other ends of the tent roof supporting rods I are connected to connection blocks 3; the connection blocks 3 are internally connected to tent roof supporting rods II 4, the other ends of the tent roof supporting rods II 4 are connected to corner connection blocks 5, and the tent roof supporting rods II 4 are snapped into plastic sliding members 6; eaves rods 7 are inserted into the sliding plastic members 6, one ends of the eaves rods 7 are connected to plastic connectors 8, one sides of the plastic connectors 8 are connected to linkage rods 9, and short rods 10 are inserted into the plastic connectors 8; one ends of the short rods 10 are connected to fastener blocks 11, foldable supporting rods 12 are connected between every two adjacent corner connection blocks 5 and between every two adjacent fastener blocks 11, fastener buttons 13 are arranged inside the fastener blocks 11, and supporting rod stretching and retracting units are inserted inside the fastener blocks 11; and the supporting rod stretching and retracting units include movable supporting rods 14, rod sleeves 16 are fixedly embedded in bottoms of the movable supporting rods 14, fixed supporting rods 15 are inserted into the rod sleeves 16, leaf springs I 17 are fixedly arranged inside the movable supporting rods 14, and leaf springs II 18 are fixedly arranged inside the rod sleeves 16.

In the implementation, in order to realize the effect of sheltering from sun and rain by the tent, and folding and storing the tent conveniently, when the tent is unfolded, the leaf springs I 17 extend into the fastener blocks 11, so that the fastener blocks 11 are fixed to exteriors the movable supporting rods 14. When the fastener blocks 11 are fixed, the tent roof supporting rods II 4 and the tent roof supporting rods I 2 are straightened to be in a parallel state through the connection blocks 3. The short rods 10 fix the eaves rods 7 through the plastic connectors 8. The eaves rods 7 are supported at two points through the plastic sliding members 6 and the plastic connectors 8, so as to be stabler when being unfolded. The eaves rods 7 extend out of a tent frame, so that tent cloth laid on an exterior of the tent extends out of the tent frame. Therefore, the effect of sheltering from sun and preventing rain from intruding into the tent in rainy days is realized. When the tent is folded, upon being ejected by the fastener buttons 13, the leaf springs I 17 are retracted into the movable supporting rods 14, and the fastener blocks 11 move along the movable supporting rods 14 without limitation. When a plurality of fastener blocks 11 move downwards, the tent roof supporting rods II 4 and the tent roof supporting rods I 2 are folded through the connection rods 3 upon the movement of the short rods 10. Moreover, the eaves rods 7 rotate upwards through the plastic connectors 8. In addition, when the fastener blocks 11 move downwards, the plurality of fastener blocks 11 drive the movable supporting rods 14 to move close to one another upon folding the foldable supporting rods 12. When the leaf springs II 18 are retracted into the fixed supporting rods 15, the limitation on the movable supporting rods 14 along the fixed supporting rods 15 is released, so that the fixed supporting rods 15 and the rod sleeves 16 are folded. Accordingly, the tent is folded as a whole, and is convenient to store.

In order to realize the objective of folding the eaves folding assemblies when the fastener blocks 11 move downwards, the device employs the technical solution as follows: one ends of the tent roof supporting rods I 2 are movably connected to the tent roof connection block 1 through rotary shafts, and the other ends of the tent roof supporting rods I 2 are movably connected to the connection blocks 3 through rotary shafts; one ends of the tent roof supporting rods II 4 are movably connected to the connection blocks 3 through rotary shafts, the other ends of the tent roof supporting rods II 4 are movably connected to the corner connection blocks 5 through rotary shafts, and the plastic sliding members 6 are hinged to the tent roof supporting rods II 4; the eaves rods 7 penetrate the plastic sliding members 6 and are slidably connected to the plastic sliding members 6, and the one ends of the eaves rods 7 are movably connected to the plastic connectors 8 through rotary shafts; one ends of the linkage rods 9 are movably connected to the plastic connectors 8 through rotary shafts, and the other ends of the linkage rods 9 are movably connected to the tent roof supporting rods II 4 through rotary shafts; one ends of the short rods 10 are movably connected to the tent roof supporting rods II 4 through rotary shafts, the other ends of the short rods 10 are movably connected to one ends of the fastener blocks 11 through rotary shafts, and the short rods 10 penetrate the plastic connectors 8 and are fixedly connected to the plastic connectors 8; and four ends of the foldable supporting rods 12 are movably connected to two corner connection blocks 5 and two fastener blocks 11 through rotary shafts respectively. The fastener buttons 13 are pressed, upon being ejected by the fastener buttons 13, the bulges I on the leaf springs I 17 are retracted into the movable supporting rods 14, and the fastener blocks 11 move along the movable supporting rods 14 without limitation. The plurality of fastener blocks 11 are dragged to move downwards. When the fastener blocks 11 move, the short rods 10 drive the plastic connectors 8 to move downwards through the rotary shafts connected to the fastener blocks. When the plastic connectors 8 move downwards, the eaves rods 7 rotate upwards to be folded through the rotary shafts connected to the plastic connectors. Moreover, the linkage rods 9 drive the tent roof supporting rods II 4 to rotate downwards to be folded about the rotary shafts connected to the corner connection blocks 5, so that the tent roof supporting rods II 4 and the tent roof supporting rods I 2 are bent inwards through the connection blocks 3. Moreover, when moving downwards, the plurality of fastener blocks 11 drive the movable supporting rods 14 to move close to one another upon folding the foldable supporting rods 12.

In order to realize the objective of folding the movable supporting rods 14 and the fixed supporting rods 15, the device employs the technical solution as follows: tops of the movable supporting rods 14 are fixedly connected to the corner connection blocks 5, the movable supporting rods 14 penetrate the fastener blocks 11 and are slidably connected to the fastener blocks 11, and the fixed supporting rods 15 are snapped into the movable supporting rods 14; the leaf springs I 17 are fixedly arranged inside the movable supporting rods 14, one sides of the leaf springs I 17 are fixedly provided with bulges I, and the bulges I penetrate the movable supporting rods 14 and extend into the fastener blocks 11; and the leaf springs II 18 are fixedly arranged inside the fixed supporting rods 15, one sides of the leaf springs II 18 are fixedly provided with bulges II, and the bulges II penetrate one side walls of the movable supporting rods 14 and one side walls of the fixed supporting rods 15 and extend out of the movable supporting rods 14 and the fixed supporting rods 15. When the fastener blocks 11 move to the leaf springs II 18, the leaf springs II 18 are pressed through the bulges II and retracted into the fixed supporting rods 15, and the limitation on the movable supporting rods 14 along the fixed supporting rods 15 is released. The movable supporting rods 14 slide downwards along the fixed supporting rods 15 through the rod sleeves 16, so that the fixed supporting rods 15 and the rod sleeves 16 are folded. Accordingly, the tent is folded as a whole, and is convenient to store.

Figure 12:
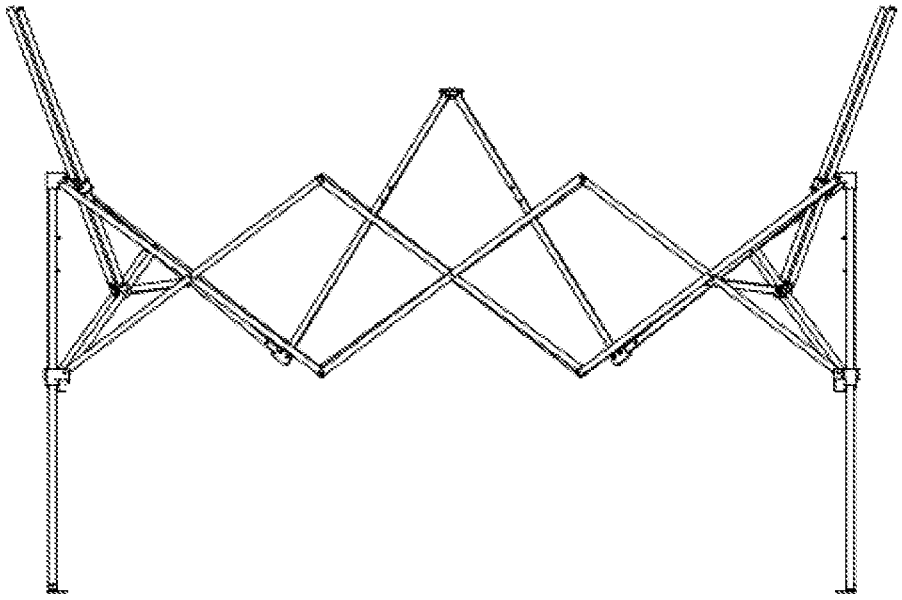
FIG. 12 is a flowchart of a folding process of an entire structure according to the disclosure.

A use process of the disclosure is as follows: when the disclosure is in use, as shown in FIG. 1, the leaf springs I 17 extend into the fastener blocks 11 in the case that the tent is unfolded, so that the fastener blocks 11 are fixed to the exteriors the movable supporting rods 14. When the fastener blocks 11 are fixed, the tent roof supporting rods II 4 and the tent roof supporting rods I 2 are straightened to be in the parallel state through the connection blocks 3. The short rods 10 fix the eaves rods 7 through the plastic connectors 8. The eaves rods 7 are supported at the two points through the plastic sliding members 6 and the plastic connectors 8, so as to be stabler when being unfolded. The eaves rods 7 extend out of the tent frame, so that the tent cloth laid on the exterior of the tent extends out of the tent frame. Therefore, the effect of sheltering from sun and preventing rain from intruding into the tent in rainy days is realized. When the tent is folded, the fastener buttons 13 are pressed, upon being ejected by the fastener buttons 13, the bulges I on the leaf springs I 17 are retracted into the movable supporting rods 14, and the fastener blocks 11 move along the movable supporting rods 14 without limitation. The plurality of fastener blocks 11 are dragged to move downwards. When the fastener blocks 11 move, the short rods 10 drive the plastic connectors 8 to move downwards through the rotary shafts connected to the fastener blocks. When the plastic connectors 8 move downwards, the eaves rods 7 rotate upwards to be folded through the rotary shafts connected to the plastic connectors. Moreover, the linkage rods 9 drive the tent roof supporting rods II 4 to rotate downwards to be folded about the rotary shafts connected to the corner connection blocks 5, so that the tent roof supporting rods II 4 and the tent roof supporting rods I 2 are bent inwards (as shown in FIG. 12) through the connection blocks 3. Moreover, when moving downwards, the plurality of fastener blocks 11 drive the movable supporting rods 14 to move close to one another upon folding the foldable supporting rods 12. When the fastener blocks 11 move to the leaf springs II 18, the leaf springs II 18 are pressed through the bulges II and retracted into the fixed supporting rods 15, and the limitation on the movable supporting rods 14 along the fixed supporting rods 15 is released. The movable supporting rods 14 slide downwards along the fixed supporting rods 15 through the rod sleeves 16, so that the fixed supporting rods 15 and the rod sleeves 16 are folded. Accordingly, the tent is folded as a whole, and is convenient to store.

What are described above are merely preferred embodiments of the disclosure. Those skilled in the art may modify the disclosure or modify the disclosure into equivalent technical solutions on the basis of the technical solutions described above. Therefore, any simple modification or equivalent substitution according to the technical solutions of the disclosure falls within the scope of protection claimed by the disclosure.

What is claimed is:

1. A foldable tent with eaves, comprising a tent roof connection block (1), wherein a plurality of eaves folding assemblies are connected to a bottom of the tent roof connection block (1), the eaves folding assemblies comprise tent roof supporting rods I (2), tops of the tent roof supporting rods I (2) extend into the tent roof connection block (1), and the other ends of the tent roof supporting rods I (2) are connected to connection blocks (3); the connection blocks (3) are internally connected to tent roof supporting rods II (4), the other ends of the tent roof supporting rods II (4) are connected to corner connection blocks (5), and the tent roof supporting rods II (4) are snapped into plastic sliding members (6); eaves rods (7) are inserted into the plastic sliding members (6), one ends of the eaves rods (7) are connected to plastic connectors (8), one sides of the plastic connectors (8) are connected to linkage rods (9), and short rods (10) are inserted into the plastic connectors (8); one ends of the short rods (10) are connected to fastener blocks (11), foldable supporting rods (12) are connected between every two adjacent corner connection blocks (5) and between every two adjacent fastener blocks (11), fastener buttons (13) are arranged inside the fastener blocks (11), and supporting rod stretching and retracting units are inserted inside the fastener blocks (11); and the supporting rod stretching and retracting units comprise movable supporting rods (14), rod sleeves (16) are fixedly embedded in bottoms of the movable supporting rods (14), fixed supporting rods (15) are inserted into the rod sleeves (16), leaf springs I (17) are fixedly arranged inside the movable supporting rods (14), and leaf springs II (18) are fixedly arranged inside the rod sleeves (16).

2. The foldable tent with eaves according to claim 1, wherein one ends of the tent roof supporting rods I (2) are movably connected to the tent roof connection block (1) through rotary shafts, and the other ends of the tent roof supporting rods I (2) are movably connected to the connection blocks (3) through rotary shafts.

3. The foldable tent with eaves according to claim 1, wherein one ends of the tent roof supporting rods II (4) are movably connected to the connection blocks (3) through rotary shafts, the other ends of the tent roof supporting rods II (4) are movably connected to the corner connection blocks (5) through rotary shafts, and the plastic sliding members (6) are hinged to the tent roof supporting rods II (4).

4. The foldable tent with eaves according to claim 1, wherein the eaves rods (7) penetrate the plastic sliding members (6) and are slidably connected to the plastic sliding members (6), and the one ends of the eaves rods (7) are movably connected to the plastic connectors (8) through rotary shafts.

5. The foldable tent with eaves according to claim 1, wherein one ends of the linkage rods (9) are movably connected to the plastic connectors (8) through rotary shafts, and the other ends of the linkage rods (9) are movably connected to the tent roof supporting rods II (4) through rotary shafts.

6. The foldable tent with eaves according to claim 1, wherein one ends of the short rods (10) are movably connected to the tent roof supporting rods II (4) through rotary shafts, the other ends of the short rods (10) are movably connected to one ends of the fastener blocks (11) through rotary shafts, and the short rods (10) penetrate the plastic connectors (8) and are fixedly connected to the plastic connectors (8).

7. The foldable tent with eaves according to claim 1, wherein four ends of the foldable supporting rods (12) are movably connected to two corner connection blocks (5) and two fastener blocks (11) through rotary shafts respectively.

8. The foldable tent with eaves according to claim 1, wherein tops of the movable supporting rods (14) are fixedly connected to the corner connection blocks (5), the movable supporting rods (14) penetrate the fastener blocks (11) and are slidably connected to the fastener blocks (11), and the fixed supporting rods (15) are snapped into the movable supporting rods (14).

9. The foldable tent with eaves according to claim 1, wherein the leaf springs I (17) are fixedly arranged inside the movable supporting rods (14), one sides of the leaf springs I (17) are fixedly provided with bulges I, and the bulges I penetrate the movable supporting rods (14) and extend into the fastener blocks (11).

10. The foldable tent with eaves according to claim 1, wherein the leaf springs II (18) are fixedly arranged inside the fixed supporting rods (15), one sides of the leaf springs II (18) are fixedly provided with bulges II, and the bulges II penetrate one side walls of the movable supporting rods (14) and one side walls of the fixed supporting rods (15) and extend out of the movable supporting rods (14) and the fixed supporting rods (15).

* * * * *